US007310041B2

(12) United States Patent
Allison et al.

(10) Patent No.: US 7,310,041 B2
(45) Date of Patent: Dec. 18, 2007

(54) CIRCUIT BREAKER

(75) Inventors: James Allison, Jackson, MI (US); William Pollock, Ann Arbor, MI (US)

(73) Assignee: MP Hollywood LLC, Jackson, MI (US)

( * ) Notice: Subject to any disclaimer, the term of this patent is extended or adjusted under 35 U.S.C. 154(b) by 378 days.

(21) Appl. No.: 10/995,600

(22) Filed: Nov. 23, 2004

(65) Prior Publication Data

US 2006/0109073 A1 May 25, 2006

(51) Int. Cl.
*H01H 37/70* (2006.01)
*H01H 37/52* (2006.01)

(52) U.S. Cl. ..... 337/66; 337/60; 337/70; 337/72

(58) Field of Classification Search ..... 337/60, 337/66, 70, 72
See application file for complete search history.

(56) References Cited

U.S. PATENT DOCUMENTS 2,513,564 A * 7/1950 Ingwersen ..... 337/55
2,514,545 A * 7/1950 Ingwersen ..... 337/55
2,625,625 A * 1/1953 Ingwersen ..... 337/74
2,689,895 A 9/1954 Ingwersen
3,848,211 A * 11/1974 Russell ..... 337/64
3,868,614 A * 2/1975 Riendeau ..... 337/66
4,272,687 A 6/1981 Borkan
5,012,495 A * 4/1991 Munroe et al. ..... 337/3
6,225,883 B1 * 5/2001 Wellner et al. ..... 335/172
6,538,549 B1 3/2003 Renne et al.
6,720,856 B1 * 4/2004 Pellon et al. ..... 337/82

* cited by examiner

*Primary Examiner*—Anatoly Vortman
(74) *Attorney, Agent, or Firm*—Synnestvedt & Lechner LLP

(57) ABSTRACT

The invention relates to a re-settable, single-phase, thermo/electric circuit breaker utilizing a U-shape bimetallic element of substantial resistance properties in the circuit, so that when a predetermined overload current occurs the bimetallic element self heats and moves to trip a mechanism that opens the breaker circuit. The invention replaces the double-contact break configuration normally associated with a breaker of this type, with a single contact break configuration designed to produce a sliding action between contacts during the normal reset operation, providing a more reliable continuity at the moveable and stationary contact interface that is also less expensive to produce.

5 Claims, 5 Drawing Sheets

PRIOR ART

CIRCUIT BREAKER

BACKGROUND OF THE INVENTION

1. Field of Use

The invention comprises a resettable thermo/electric circuit breaker of a type utilizing a single-contact break supported by a U-shaped bimetallic thermal sensing element.

2. Description of Related Art

Circuit breakers utilizing a double-contact break supported by a U-shaped bimetallic thermal sensing unit are widely used in electric circuits to prevent current overload. Examples of this type of prior art circuit breaker, all of which are assigned to the assignee of this invention, include the Series 02 circuit breaker depicted in FIG. 9 and inventions disclosed in U.S. Pat. Nos. 2,513,564; 2,514,545; and 2,689,895. Because of the relatively high contact resistance associated with the two pairs of contacts utilized in these designs, they are susceptible to intermittent loss of electrical continuity for applications involving low open circuit voltage. Each time the circuit breaker contacts are opened and reclosed, a new and unique contact interface is formed which can alter the contact resistance. Prior art designs use high contact force to elastically and plastically deform microscopic protrusions present on the contact surfaces. The resulting larger contacting area provides a lower contact resistance, but this is not always sufficient to preclude the occurrence of intermittent continuities within the circuit breaker.

SUMMARY OF THE INVENTION

The invention relates to a novel U-shaped thermal sensing element to further alleviate causes of intermittent continuity during the application of low, open circuit voltage. The circuit breaker maintains the application of high contact force found in prior art designs, and incorporates a sliding contact motion applied during circuit breaker reset to mechanically break through poorly conducting oxide, sulfide and tungstate films normally associated with the contact surfaces. A further reduction in contact resistance is achieved by eliminating one of the contact pairs. This halves contact resistance within the circuit breaker and makes it more economical to produce.

More specifically, the invention employs a single-contact break mechanism in place of the double-contact break mechanism associated with prior art U-shaped thermal sensing elements of this type. The elimination of one pair of contacts minimizes contact resistance, thereby reducing the occurrence of intermittent continuity conditions within the breaker. Additionally, upon normal reset of the breaker, the invention produces a sliding action between mating contacts, which also serves to minimize the occurrence of intermittent continuity conditions within the breaker. A further benefit of the invention is the cost savings realized by using a single pair of contacts in place of two.

These and other objects and advantages residing in the construction, combination and arrangement of parts will be more fully understood from the following specifications and drawings.

DRAWINGS

DETAILED DESCRIPTION OF THE PREFERRED EMBODIMENT

The present invention applies to push-to-reset and switchable breaker configurations, but only the push-to-reset breaker configuration is illustrated herein. The illustrated form should be considered to be a typical application but is not meant to restrict or limit the teaching to just that kind of circuit breaker.

Figure 1:
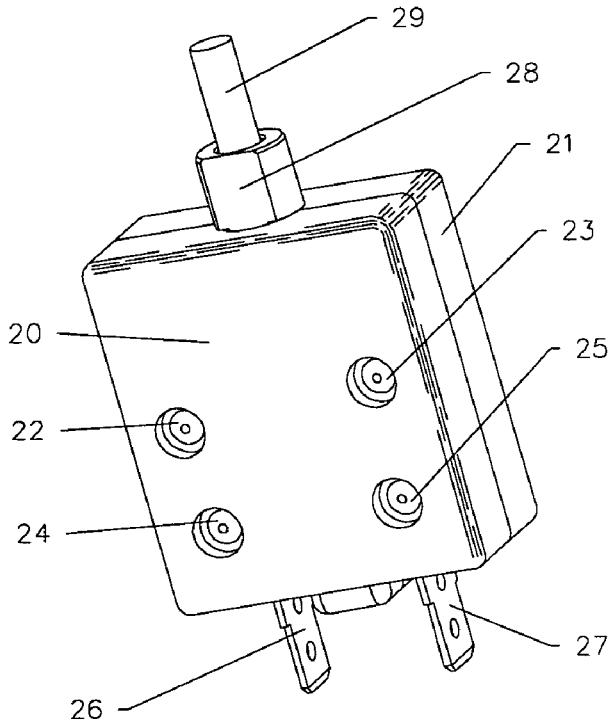
FIG. 1 is a perspective view of an electric circuit breaker in accordance with the preferred embodiment of the invention.

In FIG. 1, the circuit breaker is shown composed of two similar case halves 20 and 21 made from molded insulating material. Rivets 22, 23, 24 and 25 permanently hold the assembled breaker together. The conductors 26 and 27 used to connect the breaker to an electric circuit extend outwardly from the bottom of the case halves. Extending outwardly from the top of the case halves is a mounting sleeve 28 which provides a means to restrain the breaker for use. Extending outwardly from the top of the mounting sleeve 28 is an actuator plunger 29, which is used to reset a tripped breaker.

Figure 2:
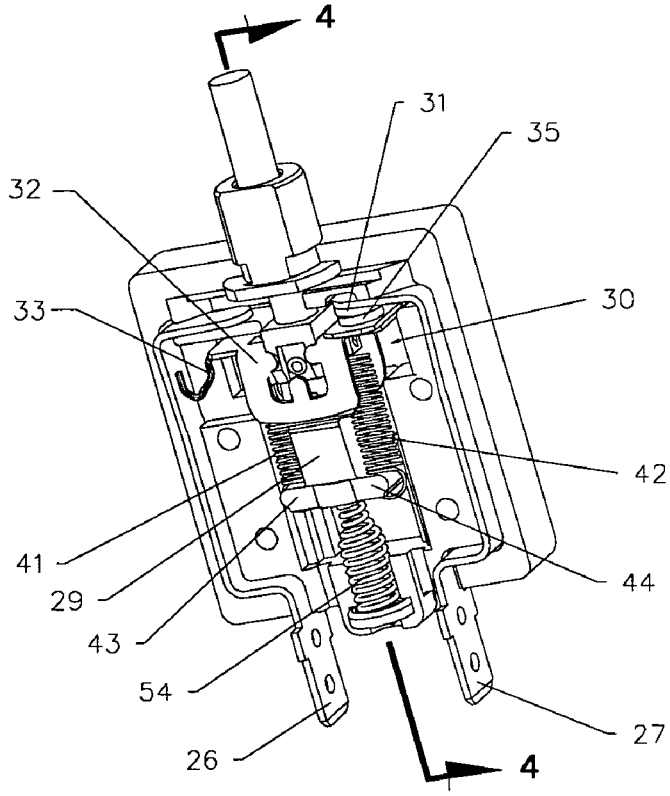
FIG. 2 is a perspective view of the electric circuit breaker shown in FIG. 1, in the closed position, with one of the case halves removed.

The casing sections combine to form an enclosed separable contact chamber, half of which is indicated generally at 30 in FIG. 2. Mounted to the interior end of one conductor 27 is a fixed contact 31 and in which chamber there is also mounted a bimetallic thermal latch and movable contact unit, indicated generally at 32, an actuator plunger 29 and a braided electrical conductor 33 that serves to electrically attach the conductor 26 to the bimetallic thermal latch and movable contact unit 32. Conductors 26 and 27 are recessed in complementary channels in the case halves and serve to key the case halves together.

Loosely mounted upon the actuator plunger 29 for both unitary and relative movement is the bimetallic thermal latch and movable contact unit 32. This unit comprises two lateral arms, best seen in FIG. 3, one of which 34 carries a movable contact 35 in opposed relation to the fixed contact 31, the other 36 is used to position the bimetallic thermal latch and movable contact unit 32 appropriately for open and closed circuit conditions; a three-tab set indicated generally as 37 serves to guide the bimetallic thermal latch and movable contact unit along the actuator plunger 29, throughout the range of breaker motion. Spring-hook tabs 39 and 40 provide anchors for the upper end of springs 41 and 42. Lateral ears 43 and 44 provide anchors for the lower ends of springs 41 and 42.

Figure 3:
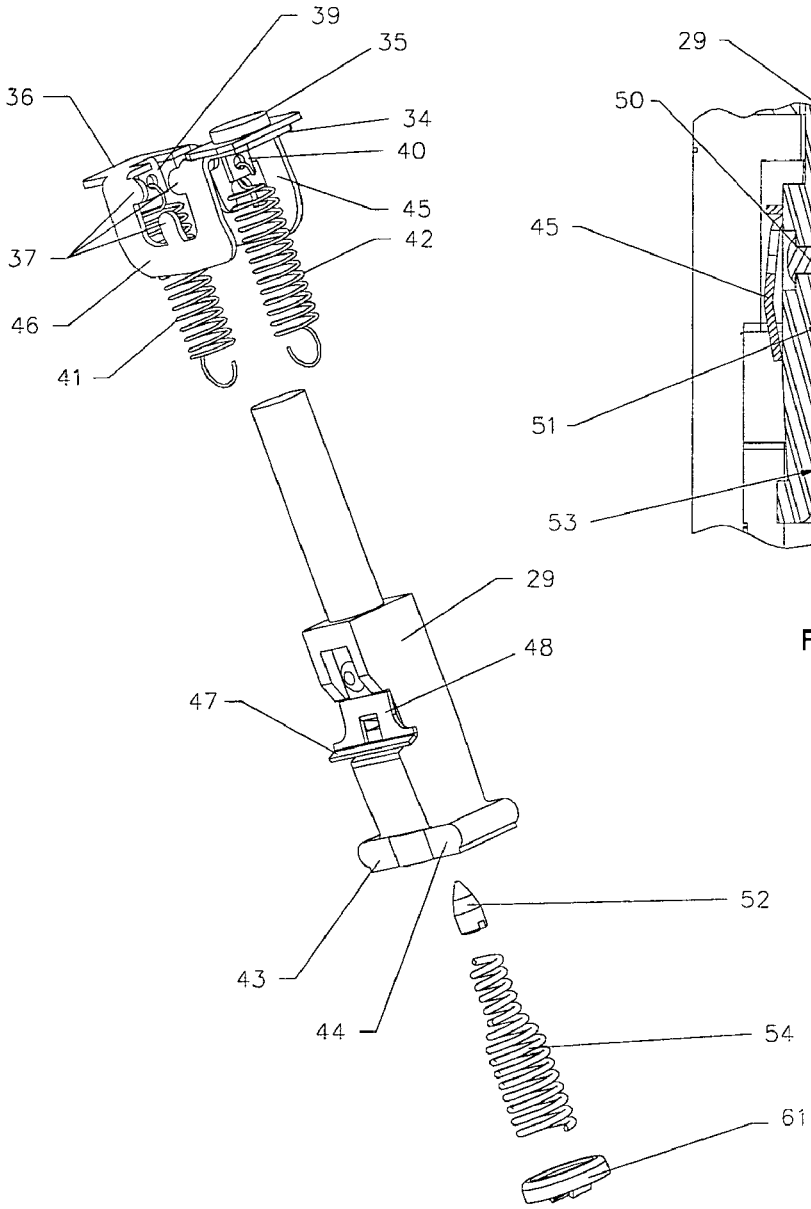
FIG. 3 is an exploded view of the parts comprising the circuit breaker latching mechanism of the invention.
Figure 4:
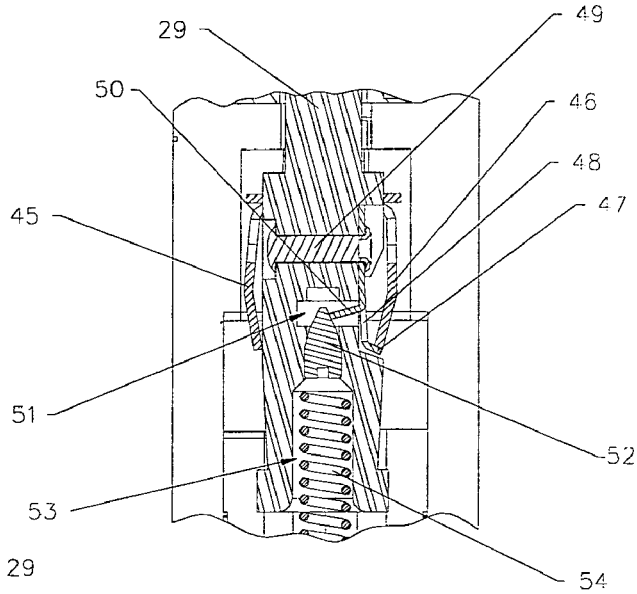
FIG. 4 is a partial, detail side elevation view of a cross section along the centerline of the breaker as indicted along lines 4-4 of FIG. 2.

FIGS. 3 and 4 show bimetallic supports 45 and 46 of the bimetallic thermal latch and movable contact unit 32 projecting downwardly on opposite sides of the actuator plunger 29. These supports have a radius on the bottom edge to allow for rotation of the bimetallic thermal latch and movable contact unit 32 during reset, and are normally stressed inwardly to provide a releasable latching engagement with the abutment ledge 47 of the catch 48. The catch 48 is secured to the actuator plunger 29 by a rivet 49. A tab 50 on the catch 48 extends into a plunger recess 51 where it rides on the conical tip of a calibration screw 52 threaded within the actuator plunger 29. Calibration of the breaker is accomplished by adjusting the calibration screw 52 in or out, effectively raising or lowering the abutment ledge 47 of the catch 48 relative to the body of the actuator plunger 29. The actuator plunger 29 provides a recess 53 for receiving the upper end of the spring 54. The opposite end of the spring 54 rests on retainer 61. Tabs on retainer 61 are initially open to allow access to the calibration screw 52. After the circuit breaker is calibrated, tabs on retainer 61 are deformed to preclude access to the calibration screw 52.

Figure 9:
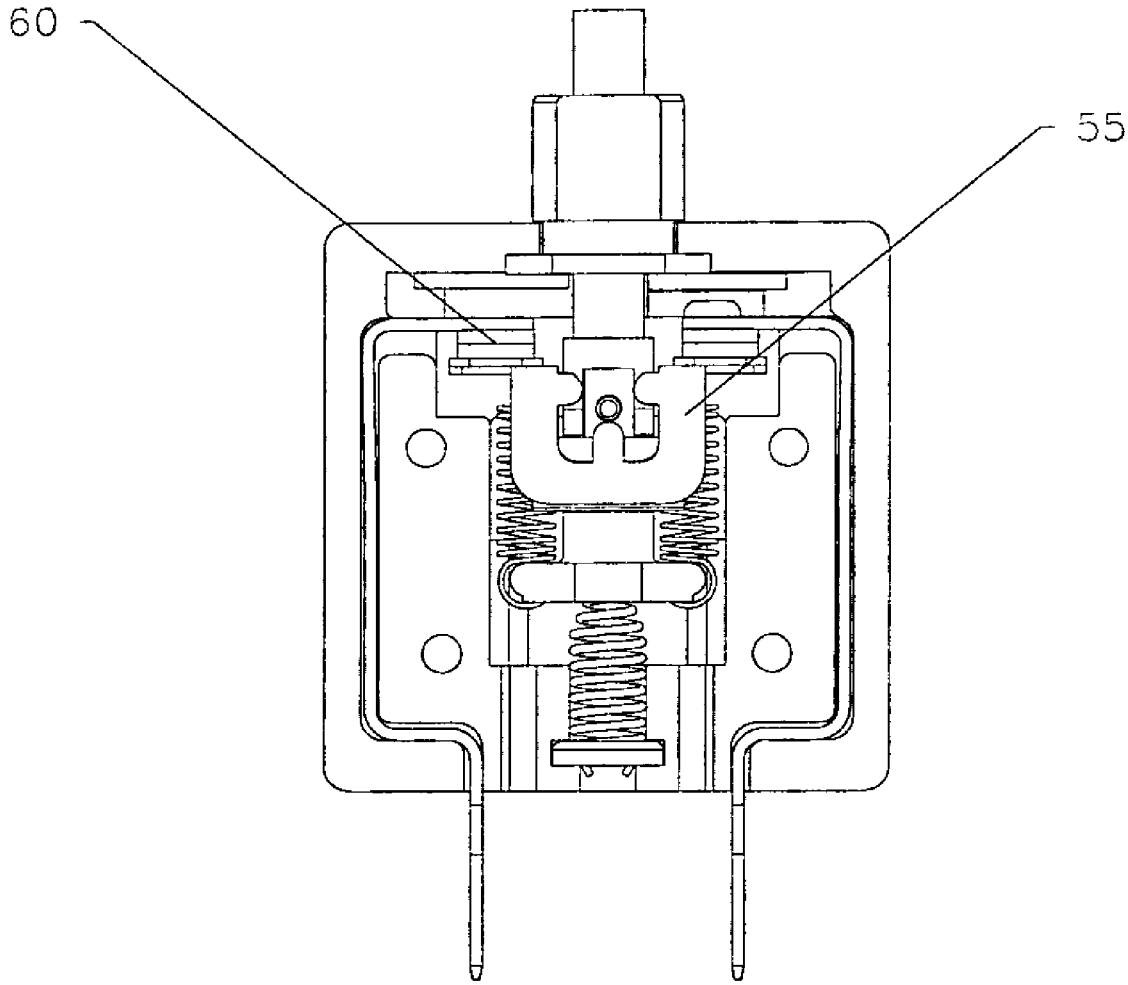
FIG. 9 is an elevation view of a prior art electric circuit breaker in the closed position, with one of the case halves removed.

In contrast, the bimetallic thermal latch and movable contact unit 55 depicted in the prior art, as seen in FIG. 9, varies significantly from the bimetallic thermal latch and movable contact unit 32 of the present invention in that it provides for a double rather than single contact-break and the radius on the downwardly projecting bimetallic supports is much larger, limiting the ability of the bimetallic thermal latch and movable contact unit 55 to self adjust for out of plane contact conditions.

OPERATION OF THE PREFERRED EMBODIMENT

Figure 5:
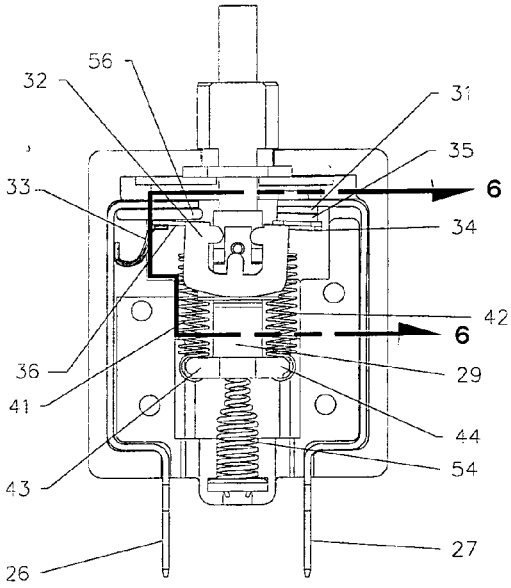
FIG. 5 is an elevation view of an electric circuit breaker in accordance with the invention, in the closed position, with one of the case halves removed.

The operation of the invention is best understood by reference to FIGS. 3 and 5 through 8C. With the present invention breaker in the closed position, as seen in FIG. 5, electrical current passes through the conductor 26, braided electrical conductor 33, bimetallic thermal latch and movable contact unit 32, movable contact 35, fixed contact 31 and conductor 27, all components connected in series. The bimetallic support 46, of the bimetallic thermal latch and movable contact unit 32 is held stressed into engagement with the abutment ledge 47 of the catch 48 (best seen in FIG. 6A) by the action of a pair of springs 41 and 42 connected between the spring-hook tabs 39 and 40 and laterally protruding ears 43 and 44. Stress between the movable contact 35 and fixed contact 31, and lateral arm 36 and the fixed abutment surface 56 is provided by the action of spring 54.

Figure 6B:
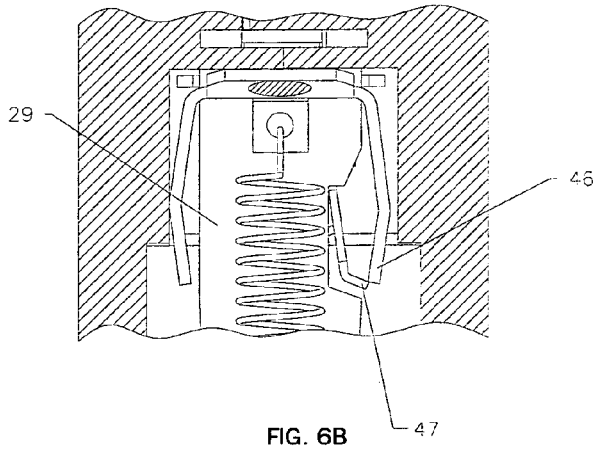
FIG. 6B is a side elevation view of a cross-section along lines 6-6 through the breaker showing a breaker just prior to tripping.
Figure 6A:
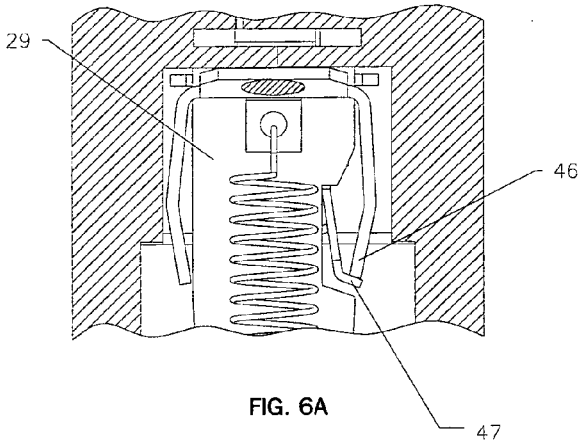
FIG. 6A is a side elevation view of a cross-section along lines 6-6 through the breaker showing a latched breaker.
Figure 7:
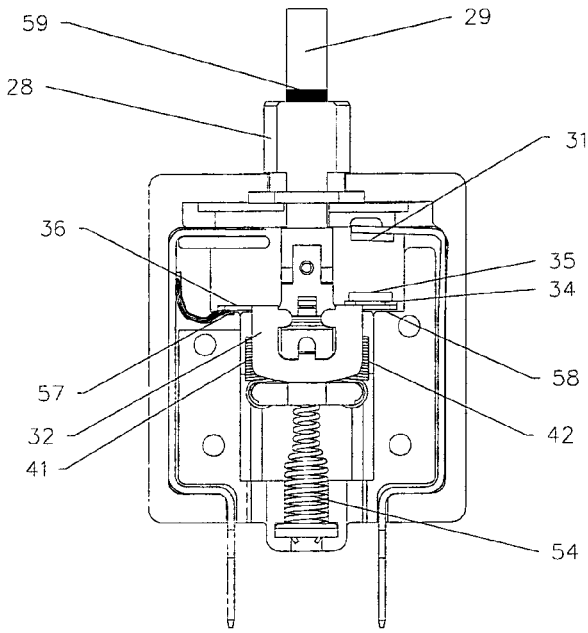
FIG. 7 is an elevation view of an electric circuit breaker in accordance with the invention, in the open position, with one of the case halves removed.

Due to the substantial resistance properties of the bimetallic thermal latch and movable contact unit 32, the bimetallic support 46 distorts laterally outwards from its position of contact with the abutment ledge 47 during the application of electrical current. The amount of lateral movement occurs at a predetermined rate dependant on the electrical current applied. When current greater than the ultimate trip value is applied distortion of the bimetallic support 46 will be sufficient to disengage it from the abutment ledge 47. FIG. 6B depicts the distortion in bimetallic support 46 immediately prior to disengagement from abutment ledge 47. As seen in FIG. 7, once disengaged, the bimetallic thermal latch and movable contact unit 32 immediately moves toward the inner end of the actuator plunger 29 due to pulling action of springs 41 and 42 causing the circuit to be broken suddenly at the contacts 31 and 35. This movement of the bimetallic thermal latch and movable contact unit 32 will be arrested when lateral arms 34 and 36 come into contact with fixed abutment surfaces 57 and 58 formed within the split casing interior. With the opening of the contacts, the actuator plunger 29 will immediately snap outwards by the action of spring 54 and cause the trip indictor band 59 to be visibly positioned outside the mounting sleeve 28.

Figure 8A:
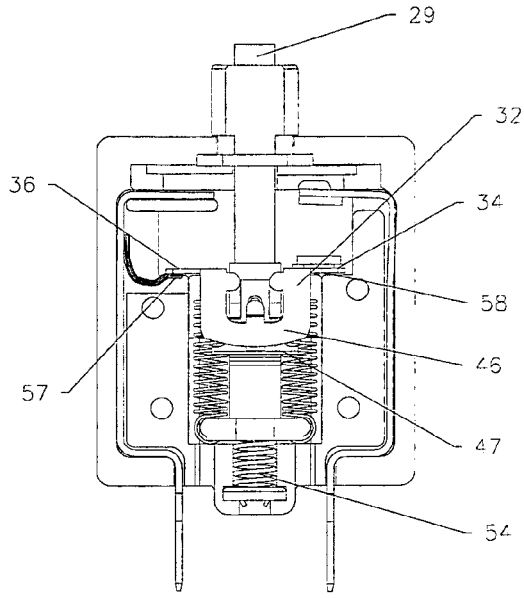
FIG. 8A is an elevation view of an electric circuit breaker in accordance with the invention, with one of the case halves removed, depicting an interim reset position.
Figure 8B:
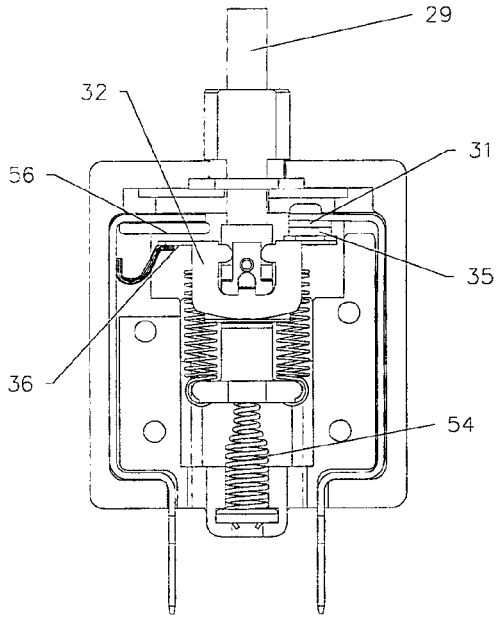
FIG. 8B is an elevation view of an electric circuit breaker in accordance with the invention, with one of the case halves removed, depicting an interim reset position.
Figure 8C:
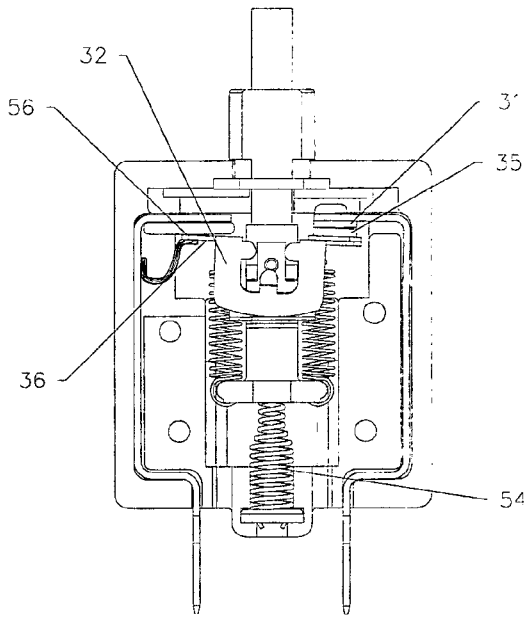
FIG. 8C is an elevation view of an electric circuit breaker in accordance with the invention, in the closed position, with one of the case halves removed.

To reset the circuit breaker, the actuator plunger 29 is pushed inwards against the energy supplied by spring 54 to position the abutment ledge 47 with respect to bimetallic support 46, it being appreciated that the bimetallic thermal latch and movable contact unit 32 is held positioned for this to take place due to the engagement of the lateral arms 34 and 36 with the abutment surfaces 57 and 58. FIG. 8A depicts this interim position. Releasing the actuator plunger 29 allows the movable contact 35 to first, engage the fixed contact 31, as seen in FIG. 8B, then slide across the fixed contact 31 as the thermal unit 32 rotates until the lateral arm 36 is arrested by a fixed abutment surface 56 within the case, as seen in FIG. 8C. The sliding of one contact over another during reset decreases contact resistance at the contact interface, making an intermittent continuity condition less likely to occur.

In contrast, the prior art electrical circuit breaker shown in FIG. 9 uses two sets of contacts, providing a double-contact break. Note the additional contact pair 60 used in the series circuit for the prior art circuit breaker, and the level, rather than canted, bimetallic thermal latch and movable contact unit 55. The contact wiping movement associated with the present invention is not provided by the prior art design.

The present invention has a number of advantages over the prior art. First, the lower contact resistance provided by the single contact pair configuration ensures it is less susceptible to intermittent loss of electrical continuity for applications involving low open circuit voltage than the double contact pair configuration employed by the prior art. Second, during normal reset of the circuit breaker, the invention creates a sliding action between mating contacts to further reduce contact resistance within the circuit breaker. Prior art designs have no such provision. Third, the invention eliminates one pair of contacts, making the circuit breaker more economical to produce.

While the invention has been described with reference to a preferred embodiment, it will be appreciated by those of ordinary skill in the art that various modifications can be made to the structure and function of the invention and its parts without departing from the spirit and function of the invention as a whole.

We claim:

1. A resettable circuit breaker apparatus comprising:

first and second exterior electrical conductors for contacting a source of electricity;

a non-moving contact connected to said second exterior electrical conductor;

a movable bimetallic latch connected to said first exterior conductor;

a movable contact for selective contact with said non-moving contact, wherein said movable contact is carried by said movable bimetallic latch and wherein said movable bimetallic latch comprises an element having a generally U-shape and includes a first and a second arm and wherein said movable contact is carried by said first arm;

a plunger for movement between a contact open position and a contact closed position, wherein said plunger has a long axis and said movable bimetallic latch is carried by said plunger;

spring means for biasing said movable bimetallic latch towards a normally contact open position;

a catch carried by said plunger, said catch including a ledge thereon for selectively engaging said movable bimetallic latch; and, a housing for substantially surrounding said apparatus and protecting it from the environment and wherein said non-movable contact is fixedly attached to said housing, wherein as electrical power passes through said movable bimetallic latch said movable bimetallic latch heats up and disengages from said ledge and said movable and non-movable contacts disengage under the influence of said spring means so that the electrical circuit between said first and second exterior conductors is opened, and further wherein when said plunger is pushed downwardly into said housing it causes said apparatus to be reset and then, when said plunger is released, said movable contact makes contact with said non-movable contact and then said movable contact slides across the face of said non-movable contact until the second arm of said U-shaped movable bimetallic latch makes contact with said housing, wherein said sliding contact improves the electrical conductivity between said movable and non-movable contacts after said circuit breaker apparatus has been reset.

2. The apparatus of claim 1 wherein said ledge is inclined with respect to the long axis of said plunger.

3. The apparatus of claim 2 further comprising:

a calibration screw means carried by said plunger for calibrating said ledge with respect to said bimetallic latch.

4. The apparatus of claim 3 wherein said spring means comprises:

first spring means for biasing said bimetallic latch towards said non-movable contact; and, second spring means for biasing said bimetallic latch away from said non-movable contact.

5. The apparatus of claim 4 further comprising:

a braided electrical wire for electrically connecting said first exterior conductor to said bimetallic latch.

* * * * *